United States Patent [19]

Mazzalupi et al.

[11] Patent Number: 4,854,402

[45] Date of Patent: Aug. 8, 1989

[54] SHAFT SINKING RIG

[75] Inventors: Giovanni Mazzalupi, Edenvale; Bruno Onofri, Kempton Park, both of South Africa

[73] Assignee: Delfos & Atlas Copco Limited, Transvaal, South Africa

[21] Appl. No.: 61,300

[22] Filed: Jun. 12, 1987

[30] Foreign Application Priority Data

Jun. 12, 1986 [ZA] South Africa ..... 86/4393

[51] Int. Cl.[4] ..... E21B 7/02

[52] U.S. Cl. ..... 175/171; 175/173; 173/37

[58] Field of Search ..... 175/85, 108, 170, 171, 175/173, 257; 173/31, 32, 33, 34, 35, 36, 37, 53, 54, 55, 56, 166, 167

[56] References Cited

U.S. PATENT DOCUMENTS

| | | | |
|---|---|---|---|
| 3,061,023 | 10/1962 | Samhammer et al. | 173/37 |
| 4,300,642 | 11/1981 | Perraud | 175/173 |
| 4,476,940 | 10/1984 | Reichert et al. | 173/37 |

*Primary Examiner*—Stephen J. Novosad
*Assistant Examiner*—William P. Neuder
*Attorney, Agent, or Firm*—Cushman, Darby & Cushman

[57] ABSTRACT

A shaft drilling rig comprises a rig head having means whereby it may be attached to a cable so as to be raised and lowered within a shaft being sunk. A central hollow column depends from the rig head and carries a base member at its lower end. There are rig supporting feet carried by the base member. The rig has a plurality of booms each being operatively carried at its upper end by the central column near the rig head to pivot relative to the column and itself carrying at its outer end a feed holder for a beam to carry a rock drill. A plurality of support members are respectively associated with the booms, each such support member being operatively carried at its lower end by the central column near the base member to pivot relative to the column and pivotally engaging its associated boom at a pivot location. Each boom has an extendable section arranged to extend the length thereof which extendable section is located between the upper end of the boom and its said pivot location.

The central column slidably carries within it a sub-assembly having at its lower end a down-the-hole hammer, rotary means for rotating the hammer, and guide means for guiding the sub-assembly within the column. There is further provided a sprocket and chain device for moving the sub-assembly relative to the column. Thus the hammer can drill a central relief hole in the floor of the shaft being sunk before the blasting takes place in the holes drilled or to be drilled by the rock drills that will be carried by the mounting heads.

8 Claims, 3 Drawing Sheets

SHAFT SINKING RIG

This invention relates to shaft sinking rigs.

The invention is concerned with a shaft sinking rig of the kind comprising a rig head having means whereby it may be attached to a cable so as to be raised and lowered within a shaft being sunk; a central column depending from the rig head; a base member at the lower end of the column; rig supporting feet carried by base member, which feet are normally carried on retractable arms that are movable from a retracted storage position to an extended operative carrying position; a plurality of booms each being operatively carried at its upper end by the central column near the rig head to pivot relative to the columm and itself carrying at its outer end a feed holder for a beam to carry a rock drill; a plurality of support members respectively associated with the booms, each such support member being operatively carried at its lower end by the central column near the base member to pivot relative to the column and pivotally engaging its associated boom at a pivot location. Such a shaft drilling rig is hereinafter referred to as "a shaft drilling rig of the kind set forth".

According to one aspect of the present invention there is provided a shaft drilling rig of the kind set forth wherein each boom has an extendable section arranged to extend the length thereof and wherein such extendable section is located between the upper end of the boom and its said pivot location.

The extendable section preferably comprises an inner part and an outer part in which the inner part is telescopically received, and jack means for moving such parts apart. The jack means preferably is contained within one or both of the said parts. The said parts are preferably box section members.

The support members may comprise extendable hydraulic jacks or they may comprise rigid struts.

According to another aspect of the invention there is provided a shaft sinking rig of the kind set forth wherein the central column is hollow and slidably carries within it a sub-assembly having at its lower end a hammer, preferably a down-the-hole hammer, rotary means for rotating the hammer, and guide means for guiding the sub-assembly within the column; the rig further comprising moving means for moving the sub-assembly relative to the column: the arrangement being such that in use the said hammer can drill a central relief hole in the floor of the shaft being sunk before the blasting takes place in the holes drilled or to be drilled by the rock drills that will be carried by the mounting heads.

The central column preferably has internal guide members of which conveniently three are provided extending among the length thereof and the guide means engage such guide members. The guide members may conveniently be comprised by angle members the apex of which is directed inwardly. The guide means may comprise rollers engaging the angle members or may preferably comprise slider blocks. An embodiment of the invention will now be described by way of example with reference to the accompanying drawings.

In the drawings:

FIG. 1 is a side view of a shaft drilling rig of the invention with one boom extended, FIG. 2 is a plan of the rig of FIG. 1 with the head omitted for clarity, FIG. 3 is a transverse section through the central column and FIG. 4 is a detail longitudinal section through the column.

DESCRIPTION OF EMBODIMENT

Figure 1:
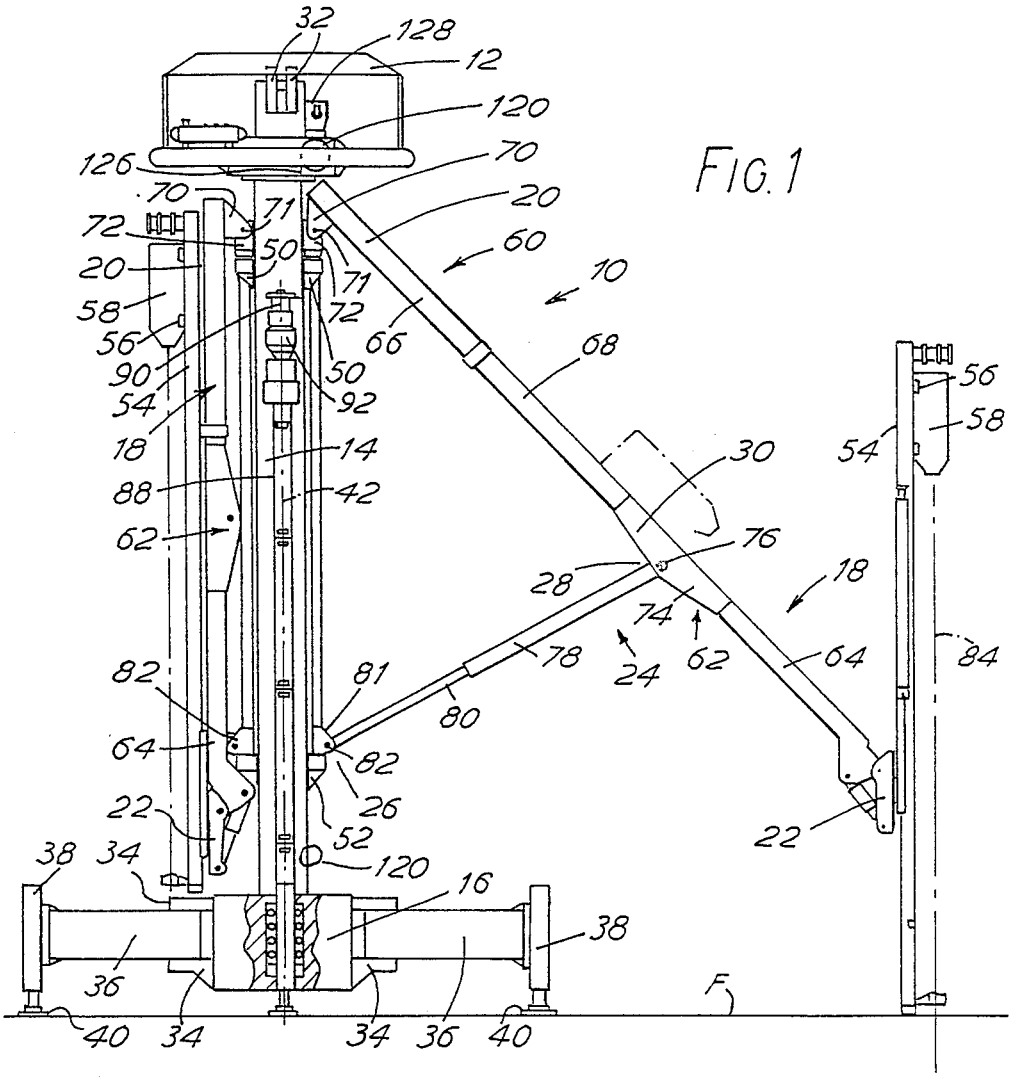
Figure 2:
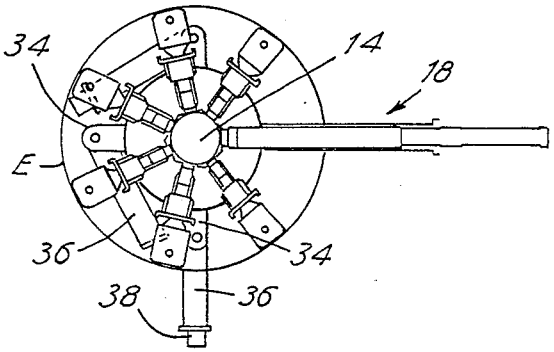
Figure 3:
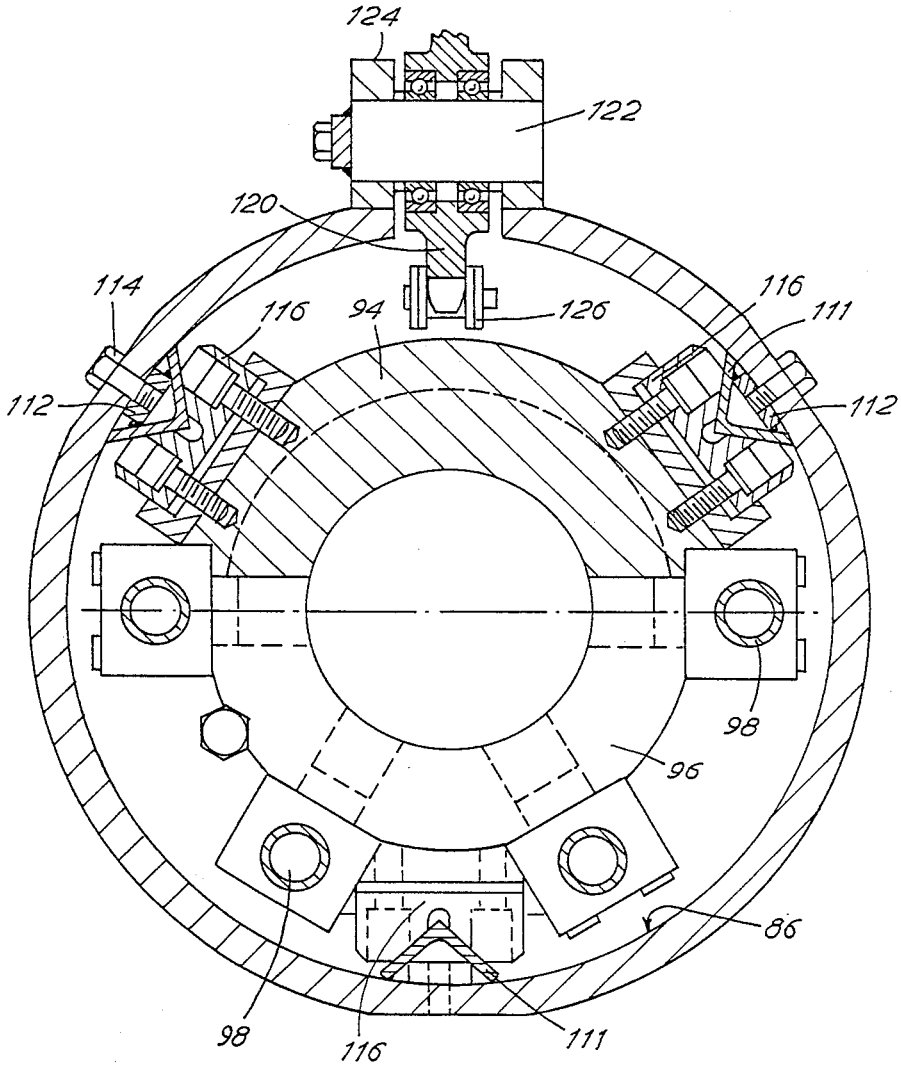

Referring now to FIGS. 1 and 2 there is shown a shaft sinking rig 10 of the invention. The rig 10 comprises a rig head 12 from which depends a central column 14 carrying a base 16 at its lower end. Seven booms 18 are pivotally carried at their upper ends 20 on the column 14 as will be described and each carries a feed holder 22 at its lower end. Seven lifting jacks 24 are pivotally carried, each at its inner end 26 by the column 14 and its outer end 28 engages an associated boom 18 at a pivot connection 30.

THE RIG HEAD 12

The rig head 12 is a hollow member. The diameter of the head is 2100 mm. The outer parts of the rig in their collapsed transport condition are contained within the extended envelope E of the rig head 12. The head has attachment lugs 32 by means of which the support cable (not shown) for the rig is attached. The head has an internal reel (not shown) and other parts as will be described.

THE BASE 16

The base 16 has four equispaced radially extending pairs of lugs 34. A robust arm 36 is pivotally mounted between each pair of lugs 34 to move between a retracted transport position in which it lies within the aforementioned envelope of the head and radially extending operative position (as shown in FIG. 1). The outer end of each arm carries a spragging jack 38 having a foot 40 at its lower end.

With all the arms in their extended positions, the spragging jacks 38 (the axes of which are slightly under two meters from the axis 42 of the column 14) will provide a stable support for the rig 10 on the floor F of the shaft being sunk. The pivot mounting of these arms 36 is such that they can be moved by hand from the transport positions to the extended positions and vice versa when desired.

The base 16 has a central aperture containing a rod guide for the purpose to be described. A power pack is provided within the base 16 driven by pneumatic power to provide hydraulic power to the spragging jacks 38 and to the lifting jacks to be described below. (The unnumbered parts referred to in this paragraph are not illustrated.)

THE COLUMN 14 (OUTSIDE CONSTRUCTION)

The column 14 is of robust construction and of substantial length such that overall height of the rig 10 is in excess of seven meters. The column 14 is of hollow circular section. It carries seven pairs of upper and lower rod mountings 50 and 52 equispaced about its periphery and located respectively near the head and base. A carrier rod 53 is pivotally carried by each pair of mountings, projecting above the upper mounting 50 and being held against axial movement by the lower mounting 52 which also acts as a thrust bearing.

THE BOOMS 18 AND LIFTING JACKS 24

Each boom 18 is of a square section box construction. The feed holder 22 is of conventional construction capable of swinging and pivotal movement as is known. The feed holder 22 slidably carries an extendable feed beam 54 on which is carried a movable cradle 56 carrying a pneumatic rock drill 58. The feed holder and the parts it carries are Atlas Copco AB's standard products and shall not be described further.

Each boom 18 is about five and a half meters length. It comprises upper, intermediate and outer sections 60, 62 and 64.

The upper section 60 comprises an outer part 66 within which is telescopically received an inner part 68. A cylinder (not shown) (hereinafter called the "internal cylinder") is received within the inner part 68 with its piston rod connected to the interior of the outer part 66. Thus this section 60 constitutes an extensible section which permits the boom 18 to extend its length by one and a half meters.

At its upper end the outer part 66 has a pair of depending lugs 70 between which is received a pivot pin 71 carried by a projection 72 on the projecting upper end of the associated rod 53. The axis of the pin 71 intersects with the axis of the rod 53.

The intermediate boom section 62 is attached to the outer end of the inner part 68. It has a pair of robust inwardly directed plates 74 between which extends a pivot pin 76. This boom section 62 constitutes the pivot connection 30. The outer boom section 64 is attached to the lower end of intermediate section 62 and as mentioned above carries the feed holder 22 at its outer end.

The lifting jack 24 has its cylinder 78 pivotally carried on the pin 76. The outer end 26 of the piston rod 80 is pivotally on a pivot pin 81 carried between a pair of lugs 82 carried by the rod 53 above the lower mounting 52. The axis of the pin 81 is spaced from the axis of the rod 53 and therefore off-set from the plane carrying the axis of the upper pin 71.

The lengths of the boom 18, the jack 24 and the rod 54 are such that with the jack 24 and the internal cylinder contracted (and further with the beam 54 in its rearmost position), the boom 18 will be in its retracted transport position and will be parallel to the column 14 beside the rod 53 (as shown to the left in FIG. 1) and within the aforementioned extended envelope of the head 12. In this transport position of the beam, the pivot pins 71, 81 and 76 lie on the corners of a very flat triangle.

On extension of the jack 24 or the internal cylinder, the boom 18 will swing outwardly to form a more acute angled triangle. By means of the extension shaft section 60, the location of the feed holder 22 can be maintained at a convenient distance from the floor F. With both the jack 24 and internal cylinder fully extended, the distance of the axis 84 of the rock drill (in its vertical condition) from the columm axis 42 will be about five meters.

Of course holes can be drilled still further from the column by pivoting the feed holds 22 and the beam 54 in known manner.

It will be seen that as the boom sections 62 and 64 are of fixed length the amount of cantilever of the boom beyond the pivot connection 30 is constant irrespective of the degree of extension of the upper boom section 60. Further with the upper boom section 60 extended, the jack 24 will more nearly approach the horizontal to give a better distribution of forces.

THE COLUMN 14 (INTERNAL CONSTRUCTION AND CONTENTS) (SEE FIGURES 3 AND 4)

As mentioned above, the column 14 is of hollow circular section construction. It has a 405 mm outer diameter, a 280 mm inner diameter and a 12.5 mm wall thickness. Within the bore 86 of the column 14 there is contained a down-the-hole hammer (the "DHT hammer") (not shown) at the lower end of a drill string 88. At the upper end of the drill string 88 there is a pneumatically driven rotary motor 90 which connects to the drill string through a gear box 92. The gear box 92 drives a pneumatic connector 94 through which pneumatic power is delivered through the hollow drill string 88 to the DTH hammer.

Figure 4:
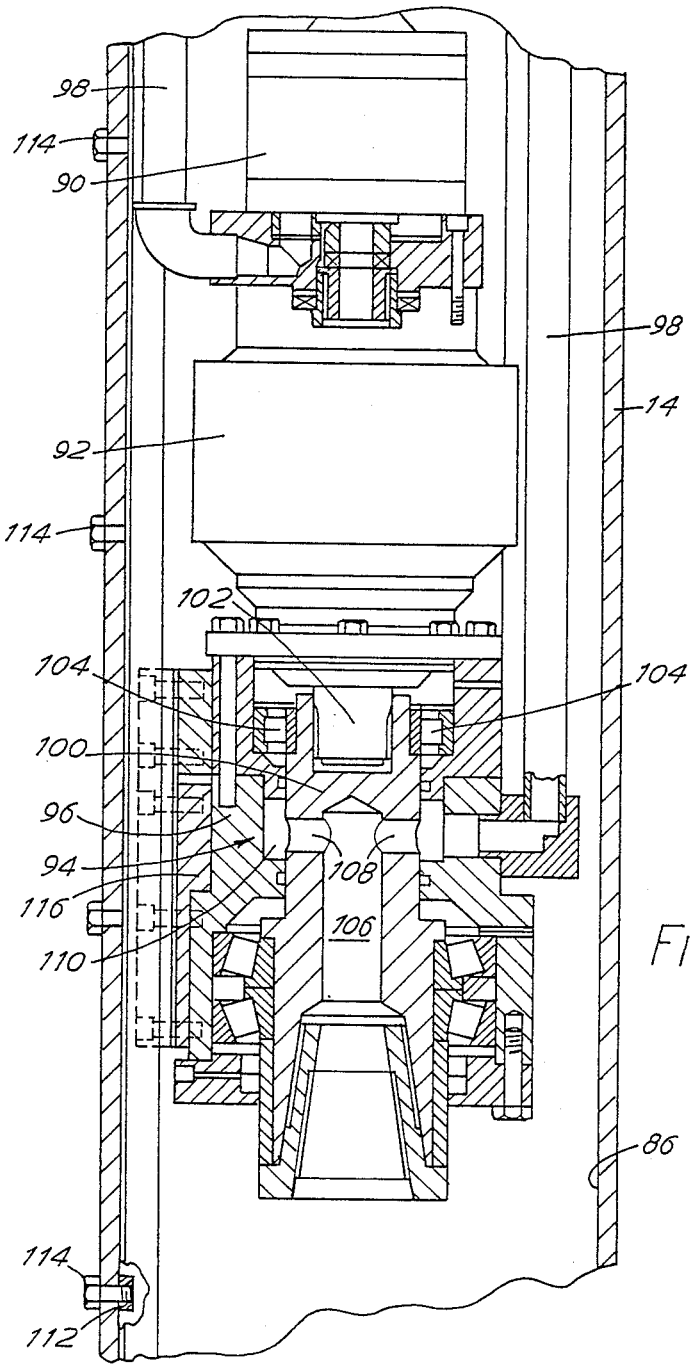

The connector 94 comprises a body 96 (see FIG. 4) that is held against rotation as will be described and is connected by means of flexible pipes 98 to the source of pneumatic power. Within the body 96 is an inner member 100 that is secured to the output shaft 102 of the gear box 92 and is mounted by suitable bearings 104. The connector 100 has a central bore 106 which terminates at its upper end in a pair of radial bores 108 that are in pneumatic contact with an internal annular groove 110 in the body 96 and connected to the pipes 98.

Running down the wall of the bore 86 are three longitudinally extending, equispaced, steel angle members 111. The angle members 111 are removably carried, being welded on to nut members 112 that are engaged by bolts 114 passing through openings in the column 14. Elongated bronze pad members 116 are bolted on to the body 96 and engage the angle members 111 whereby the body and motor 90 are held against rotation within the column 14.

Near the upper end of the column 14 and near its lower end there are two sprocket wheels 120 mounted on pins 122 each carried between a pair of lugs 124 on the outside of the column 14. The sprocket wheels project into the column 14 and carry a robust chain 126 the ends of which are connected to the body 96. A pneumatic motor 128 located within the head 12 drives the upper sprocket wheel 120 through a gear box in known manner to raise and lower the drill string 88 and the parts carried thereby.

Also contained within the head 12 are reels for the pipes 98 and the air pipe to the motor 90.

The arrangement above described permits the DTH hammer to drill a central relief bore in the centre of the floor F of the shaft being sunk at the same time as the various other bore holes are being drilled by rock drills 58.

It will be appreciated that as the pad members 116 are bronze, these will wear rather than the steel angle members and will be easy to replace.

GENERAL

The invention is not limited to the precise constructional details hereinbefore described and illustrated in the drawings. For example instead of pad members 116, a roller arrangement may be provided. The centre hole drilling arrangement can be provided with other shaft sinking rigs having a central column as described above. The sub-assembly incuding the down-the-hole hammer may be ommitted. In such circumstances, the lower portion of the column 14 may comprise a reservoir for hydraulic fluid as well as a power pack for jacks which may be provided to move the arms carrying the ground engaging feet from the retracted to the extended positions.

While the presently preferred embodiment of the invention has been given for the purpose of disclosure, changes can be made therein which are within the spirit of the invention as defined by the scope of the appended claims.

What is claimed is:

1. A shaft drilling rig comprising (a) a rig head having means whereby it may be attached to a cable so as to be raised and lowered within a shaft being sunk;

(b) a central column depending from the rig head;

(c) a base member at the lower end of the column;

(d) a rig support comprising:

(d)(i) retractable arms, each having an inner and an outer end, the said inner ends being pivottally carried on the said base member to move from a retracted storage position to an extended operative carrying position; and (d)(ii) rig supporting feet carried respectively by the said outer ends of the said retractable arms;

(e) a plurality of booms, each boom having an upper end and an outer end, each said boom (e)(i) being carried at its upper end by the central column near the rig head to pivot relative to the column, and (e)(ii) having an extendable section located between the said upper and outer ends and being arranged to extend the length thereof;

(f) a feed holder carried at the outer end of each boom, the feed holder having means to support a beam to carry a rock drill; and (g) a plurality of support members respectively associated with the booms, each such support member having an upper and and a lower end, each such support member (g)(i) being carried at its lower end by the central column near the base member to pivot relative to the column and (g)(ii) at its upper end pivotally engaging its associated boom at a pivot location between said extendable section and the said outer end of the boom.

2. A rig as claimed in claim 1 wherein the support members comprise extendable hydraulic jacks.

3. A shaft drilling rig comprising (a) a rig head having means whereby it may be attached to a cable so as to be raised and lowered within a shaft being sunk;

(b) a hollow central column depending from the rig head;

(c) a base member at the lower end of the column;

(d) a support comprising:

(d)(i) retractable arms, each said retractable arm having an inner and an outer end, the said inner ends being pivottally carried on the said base member to move from a retracted storage position to an extended operative carrying position, and (d)(ii) rig supporting feet carried respectively by the said outer ends of the said retractable arms:

(e) a plurality of booms, each boom having an upper end and an outer end, each said boom being carried at its upper end by the central column near the rig head to pivot relative to the column;

(f) a feed holder carried at the outer end of each boom, the feed holder having means to support a beam to carry a rock drill; and (g) a plurality of support members respectively associated with the booms, each such support member having an upper end and an outer end, each such support member (g)(i) being carried at its lower end by the central column near the base member to pivot relative to the column, and (g)(ii) at its upper end pivotally engaging its associated boom at a pivot location between the said ends of the boom;

(h) a sub-assembly slidably carried within the said hollow column, the said sub-assembly having (h)(i) a hammer at its lower end, (h)(ii) rotary means for rotating the hammer, and (h)(iii) guide means for guiding the sub-assembly within the column; and (j) moving means connected to the said sub-assembly for moving the sub-assembly relative to the column;

the arrangement being such that in use the said hammer can drill a central relief hole in the floor of the shaft being sunk before the blasting takes place in the holes drilled or to be drilled by the rock drills that will be carried by the mounting heads.

4. A rig as claimed in claim 3 wherein the hammer is a down-the-hole hammer,

5. A rig as claimed in claim 3 wherein the central column has internal guide members extending among the length thereof and the guide means engage such guide members.

6. A rig as claimed in claim 5 wherein the guide members comprise angle members the apices of which are directed inwardly.

7. A rig as claimed in claim 5 wherein the guide means comprise slider blocks engaging the angle members.

8. A shaft drilling rig comprising (a) a rig head having means whereby it may be attached to a cable so as to be raised and lowered within a shaft being sunk;

(b) a central column depending from the rig head;

(c) a base member at the lower end of the column;

(d) a support comprising:

(d)(i) retractable arms, each having an inner and an outer end, the said inner ends being pivottally carried on the said base member to move from a retracted storage position to an extended operative carrying position, and (d)(ii) rig supporting feet carried respectively by the said outer ends of the said retractable arms;

(e) a plurality of booms, each boom having an upper end and an outer end, each said boom comprising (e)(i) an upper section having an upper end and an inner end, the said upper end being carried by the central column near the rig head to pivot relative to the column, (e)(ii) an outer section having inner and outer ends, and (e)(iii) an extendable section located between the upper and outer sections, the extendable section comprising an inner part and an outer part within which the said inner part is telescopically received, one of the said parts being connected to the upper section and the other of the said parts being connected to the outer section, the extendable section further comprising jack means contained within at least one of the said parts and being connected thereto to move the said parts relative to one another;

(f) a feed holder carried at the outer end of each boom, the feed holder having means to support a beam to carry a rock drill; and (g) a plurality of hydraulic jacks respectively associated with the booms, each said hydraulic jack having an upper end and a lower end, and (g)(i) being carried at its lower end by the central column near the base member to pivot relative to the column, and (g)(ii) at its upper end pivotally engaging its associated boom at a pivot position located between such extendable section and the said lower end of the boom.

* * * * *

UNITED STATES PATENT AND TRADEMARK OFFICE

CERTIFICATE OF CORRECTION

PATENT NO. : 4,854,402

DATED : August 8, 1989

INVENTOR(S) : MAZZALUPI, Giovanni NMI and ONOFRI, Bruno

It is certified that error appears in the above-identified patent and that said Letters Patent is hereby corrected as shown below:

ON THE FIRST INFORMATION PAGE:

Please Change

"(73) Assignees: Delfos & Atlas Copco Limited, Transvaal, South Africa" To

---(73) Assignees: Delfos & Atlas Copco Limited, Transvall, South Africa and Shaft Sinkers Limited ---.

Signed and Sealed this

Second Day of October, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. :4,854,402

DATED :August 8, 1989

INVENTOR(S) : MAZZALUPI, Giovanni NMI and Onofri, Bruno

It is certified that error appears in the above-identified patent and that said Letters Patent is hereby corrected as shown below:

ON TITLE PAGE:

Please Change

"(73) Assignees: Delfos & Atlas Copco Limited, Transvall, South Africa and Shaft Sinkers Limited"

to

--(73) Assignees: Delfos & Atlas Copco (Proprietary) Limited & Shaft Sinkers (Proprietary) Limited Transvaal,South Africa & Sandton, South Africa This Certificate supersedes Certificate of Correction issued October 22, 1990.

Signed and Sealed this

Twenty-third Day of June, 1992

*Attest:*

DOUGLAS B. COMER

*Attesting Officer*

*Acting Commissioner of Patents and Trademarks*